US005296054A

United States Patent [19]

Lvovich et al.

[11] Patent Number: 5,296,054

[45] Date of Patent: Mar. 22, 1994

[54] AUSTENITIC STEEL

[75] Inventors: Levin F. Lvovich; Goronkova A. Dmitrievna; Kzasnykh V. Ivanovich, all of Moscow, U.S.S.R.; Rolf Kirchheiner; Michael Köhler, both of Iserlohn, Fed. Rep. of Germany; Ulrich Heubner, Werdohl, Fed. Rep. of Germany

[73] Assignees: I.P. Bardin Central Research Institute of Iron & Steel, Moscow, U.S.S.R.; Krupp-VDM GmbH, Werdohl, Fed. Rep. of Germany

[21] Appl. No.: 894,035

[22] Filed: Jun. 4, 1992

[30] Foreign Application Priority Data

Jun. 5, 1991 [DE] Fed. Rep. of Germany ..... 4118437

[51] Int. Cl.[5] ..... C22C 38/34

[52] U.S. Cl. ..... 148/327; 420/36; 420/50

[58] Field of Search ..... 420/50, 584.1, 585, 420/36; 148/327

[56] References Cited

U.S. PATENT DOCUMENTS 4,279,648 7/1981 Ito et al. ..... 420/50

5,120,496 6/1992 Horn et al. ..... 420/50

*Primary Examiner*—Deborah Yee

*Attorney, Agent, or Firm*—Meltzer, Lippe, Goldstein, Wolf Schlissel & Sazer

[57] ABSTRACT

The invention relates to a high-silicon-content corrosion-resistant austenitic steel, characterized by alloying contents (in % by weight) of

| | |
|---|---|
| max. 0.2% | C |
| 10 to 25% | Ni |
| 8 to 13% | Cr |
| 6.5 to 8% | Si |
| 0 to 10% | Mn and/or Co |
| max. 0.010% | S |
| max. 0.025% | P |

residue iron and the usual admixtures and impurities due to manufacture.

The steel is suitable as a material for the production of corrosion-resistant articles for the handling of highly concentrated hot sulphuric acid, highly concentrated hot nitric acid and other strongly oxidizing media, such as chromic acid, in the form of rolled plates, strips, pipes, rods, wires and other forms of product.

6 Claims, 3 Drawing Sheets

AUSTENITIC STEEL

BACKGROUND OF THE INVENTION

Figure 1:
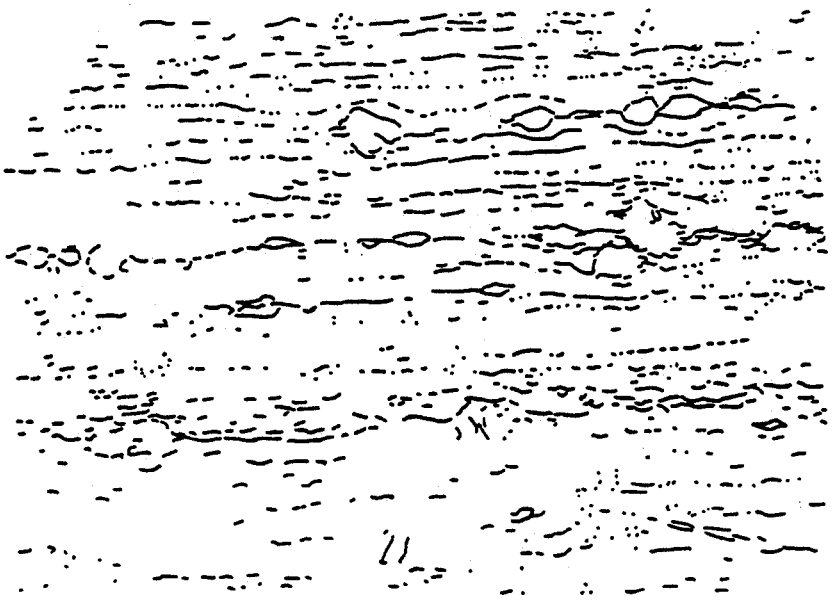

The invention relates to a high-silicon-content corrosion-resistant austenitic steel and its use for the handling of strongly oxidizing media, such as hot highly concentrated sulphuric acid and hot highly concentrated nitric acid.

More particularly for the handling of highly concentrated hot nitric acid, the steel X2CrNiSi1815 was developed, which contains 3.7 to 4.3% silicon in addition to 17 to 18% chromium and 14.5 to 15.5% nickel (all details in % by weight). High resistance to corrosion in superazeotropic, more particularly highly concentrated nitric acid can be achieved only by a minimum silicon content of 3.7% (E. M. Horn, A. Kügler, Z. Werkstofftechnik, Vol. 8, 1977, pages 362 to 370, 410 to 417). In that case the chromium content is approximately I8%, so that passivation can take place in other aqueous solutions also. The relatively high nickel content of approximately 15% is necessary to achieve an austenitic base structure. The effect of higher silicon contents than approximately 4% was also investigated in the past (E. M. Horn, R. Kilian, K. Schoeller, Z. Werkstofftechnik, Vol. 13, 1982, pages 274 to 285). German OS 28 22 224 discloses a steel containing 2.5 to 5% silicon, 15 to 20% chromium, 10 to 22% nickel, max. 2% manganese, max. 0.1% carbon and additions of a further alloying component consisting of tantalum, zirconium or a mixture of niobium and tantalum and/or zirconium for the production of corrosion-resistant spring plates. British Patent 2 036 077 discloses inter alia an austenitic steel of improved resistance to oxidation at elevated temperatures which consists of 1 to 5% silicon, 15 to 30% chromium, 7 to 35% nickel, not more than 3% manganese, max. 0.10% carbon, residue iron and impurities, the sulphur content also being limited to max. 0.003%. A steel is also commercially available which has a silicon content raised to 5 to 5.6%, the nickel content being increased to approximately 17.5%, to enable an austenitic structure still to be established. British Patent 2 122 594 claims the use of such a steel for parts of installations required for the production of sulphuric acid. Nevertheless, as a rule in the prior art no higher silicon content than approximately 4.5% is selected, since with chromium contents of approximately 18% the precipitation of carbides and intermetallic phases as a whole is accelerated by increasing silicon contents.

The steel containing approximately 4% silicon is included under Case 1953 in the ASME Boiler und Pressure Vessel Code, Sect. VIII, Div. 1. The strong tendency to precipitation demands inter alia special steps during welding (R. R. Kirchheiner, F. Hofmann, Th. Hoffmann, G. Rudolph, Materials Performance, Vol. 26, No. 1, 1987. pages 49–56). Furthermore an austenitic steel containing 3.5 to 4.5% silicon, 16 to 18% chromium, 8 to 9% nickel, 7 to 9% manganese, max. 0.10% carbon and 0.08 to 0.18% nitrogen is offered on the market as a particularly wear-resistant material under the name Nitronic 60.

In addition to the aforementioned austenitic silicon-containing Steels, European patent 0 135 320 discloses a silicon-containing austenitic-ferritic steel which is supposed to be particularly suitable for the handling of such solutions of nitric acid as are used in the processing of nuclear reactor fuel elements. Its composition is stated as 2 to 6% silicon, 20 to 35% chromium, 3 to 27% nickel, 0.1 to 2% manganese, max. 0.03% nitrogen, max. 0.04% carbon, at least one of the elements niobium, titanium or tantalum in a quantity 8 times the carbon content or more, but at most 1%, residue mainly iron. With a view to the same field of application, European Patent 0 135 321 discloses a silicon-containing austenitic steel having improved resistance to corrosion caused by nitric acid, its composition being stated as follows: 2 to 6% silicon, 20 to 35% chromium, 17 to 50% nickel, 0.01 to 8% manganese, max. 0.03% nitrogen, max. 0.03% carbon, at least one of the elements niobium, titanium and tantalum in a quantity 8 times the carbon content or more, but 1% at most, residue mainly iron.

However, an overall consideration of the aforementioned silicon-containing corrosion-resistant steels shows that even with Si contents up to 6%, resistance is inadequate in highly concentrated hot sulphuric acid at temperatures above 100° C., taking in account a maximum corrosion rate of 0.3 mm per annum, which is tolerable for practical applications.

According to British Patent 1 534 926 a corrosion rate lower than 0.3 mm per annum, tested in 95.6% sulphuric acid at 110° C., can be achieved with the following alloy composition: 4.1 to 12% silicon, 6 to 22% chromium, 10 to 40% nickel. 0.6 to 4% copper, max. 4% manganese, max. 1.5% molybdenum plus ½ tungsten, max. 0.2% nitrogen, max. 0.06% carbon, total max. 2% for the elements niobium, tantalum, zirconium and vanadium, residue mainly iron. According to this Patent Specification the optimum silicon content is normally supposed to be 7.5 to 10%, the chromium content being preferably 9 to 14%, the nickel content preferably 14 to 20% and the copper content 2 to 3%.

However, at test temperatures of 150° C. and above, the corrosion rates appreciably exceed the limit value of 0.3 mm per annum relevant in practice, as tests carried out at a neutral Institute showed in the testing of commercially available steels having the composition stated in the analysis given in British Patent 1 534 926. In those tests the most favourable corrosion rate in 96% sulphuric acid at a test temperature of 150° C. was 0.5 mm per annum.

Moreover, due to its high silicon content in combination with the copper content this steel is difficult to work, so that rolled products of relatively large dimensions, such as plates and pipes, can be produced only to a limited extent. To improve hot workability, a total of up to 0.5% magnesium, aluminium and calcium and also up to 0.2% rare earth metals must be added to that steel.

Starting from this prior art it is an object of the invention to provide a satisfactorily workable silicon-containing austenitic steel which can be processed into rolled products of relatively large dimensions, such as plates and pipes, and which is adequately corrosion-resistant for practical use in the handling of highly concentrated hot sulphuric acid, highly concentrated hot nitric acid and other strongly oxidizing media (rate of corrosion below 0.3 mm per annum).

This problem is solved by an austenitic steel having alloying contents of max. 0.2% carbon, 10 to 25% nickel, 8 to 13% chromium, 6.5 to 8% silicon, 0 to 10% manganese and/or cobalt, max. 0.010% sulphur, max. 0.025% phosphorus, residue iron and usual admixtures and impurities due to manufacture (all details in % by weight).

The advantageous properties of this steel and its particular features as set forth in the subclaims will now be explained:

FIG. 1: Microstructure of steel No. 6 after rolling to 5 mm plate thickness, magnification X-200

Figure 2:
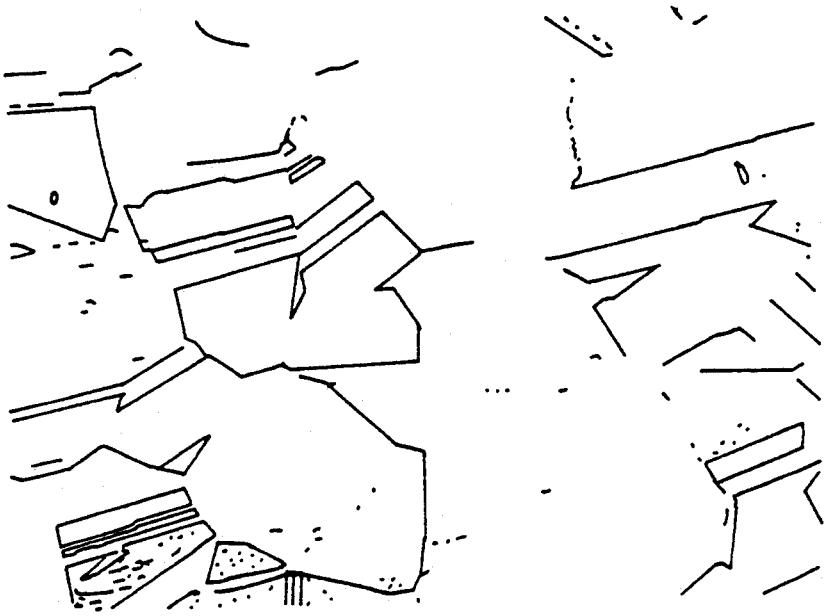

FIG. 2: Structure of steel No. 6 after rolling to 2 mm thickness and solution annealing, magnification X-200

Figure 3:
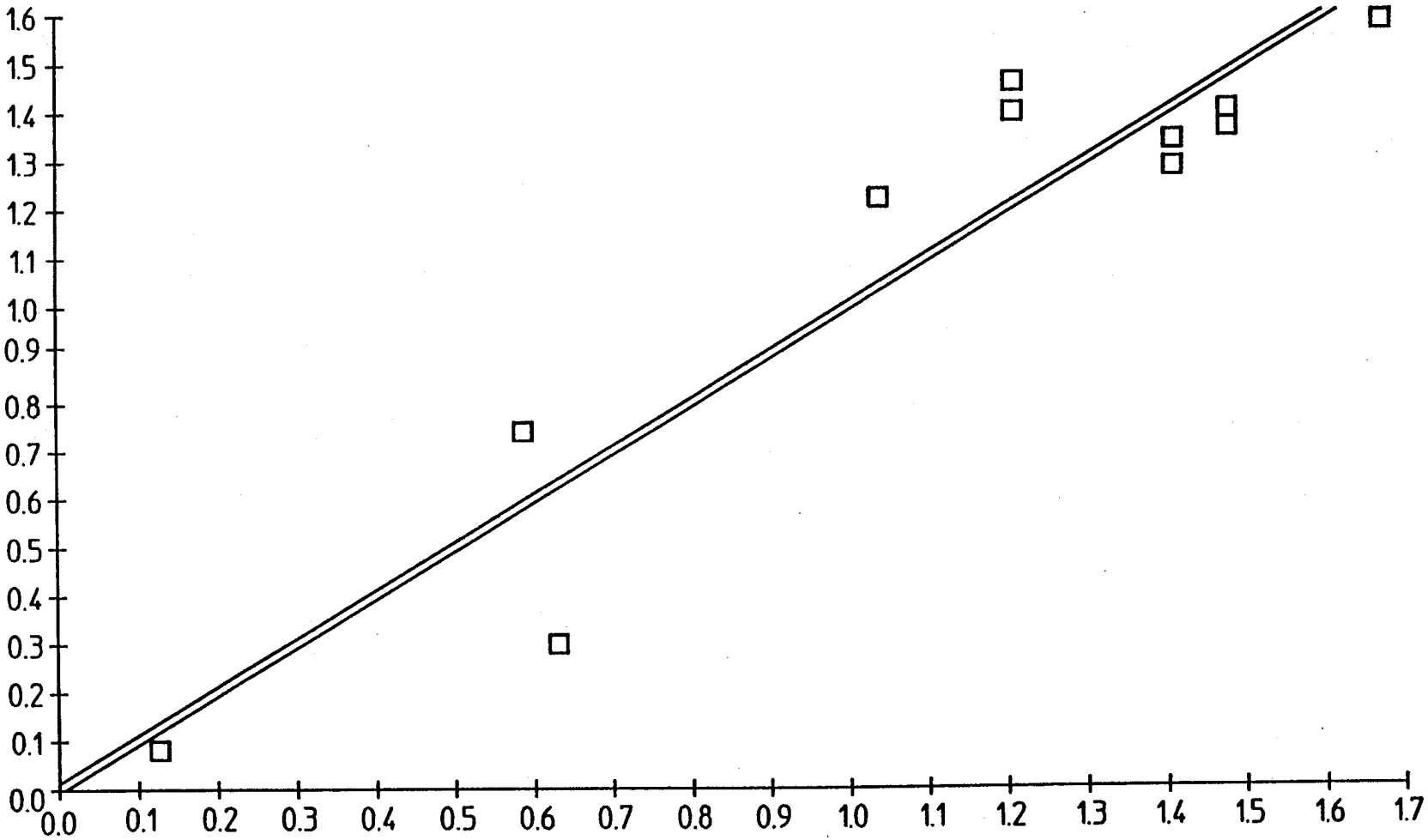

FIG. 3 (Caption): Corrosion abrasion of Si-containing austenitic steels in 96% sulphuric acid at 150° C. as a function of the chromium, nickel and silicon content Ordinate: corrosion rate in mm per annum FIG. 4: Corrosion abrasion of a steel with 22% nickel and 0.02% carbon in 98% nitric acid at 100° C., measured over 100 hours, plotted in dependence on the chromium and silicon content of the steel.

Ordinate: corrosion abrasive loss in $g/m^2.h$;

abscissa: (left) chromium in %; (right) silicon in %.

Reference will be made to eight experimental alloys having the composition stated in Table 1 which were rolled into plates after melting. In Table 1 the alloys are arranged in increasing silicon content. Alloys 1, 4, 5 and 8 and also 2, 3 and 7 came from two independent Laboratories, alloy 6 originated from an operational melt by the Applicants. The alloys 1 to 4 are prior art alloys, while the alloys 6 to 8 are austenitic steels according to the invention within the preferred composition stated in claim 2.

Table 2 shows the corrosion abrasion of these alloys in 96 and 98.5% sulphuric acid at 150° and 200° C. In the first place, Table 2 makes it clear that the values which it presents for averaged linear corrosion rate are obviously reproducible enough, since in the case of experimental alloys Nos. 1, 4 and 5, two series of each of which were tested, the mean values of the measurements are so close to one another that the behaviour of these alloys can be differentiated from that of the other alloys. Table 2 also indicates that the corrosion abrasion in 98.5% sulphuric acid is distinctly lower than in 96% sulphuric acid. The corrosion abrasion in 96% sulphuric acid is therefore decisive for the evaluation of the alloys as regards their usability in hot sulphuric acid in a concentration of 96% and above. If the corrosion abrasion in 96% sulphuric acid at 150° C. is considered in this sense (first column of Table 2) and compared with the alloy composition stated in Table 1, the following relation can be determined by a linear regression calculation:

$$\text{Corrosion rate (mm per annum)} = 8.166 - 0.982 \times \%\,Si - 0.057 \times \%\,Cr - 0.021 \times \%\,Ni \quad (1)$$

Accordingly, in 96 % sulphuric acid at 150° C. the silicon content of the alloys is mainly decisive for resistance to corrosion, then —but to an approximately seventeen times lesser extent—the chromium. According to this equation (1) an increasing nickel content is also advantageus for resistance to corrosion.

It follows from this that the silicon content of the alloys according to the invention must be as high as possible. This is offset by the following: firstly, both silicon and chromium are strong ferrite formers; secondly, for reasons of ready workability the alloys must contain only small amounts of ferrite, if any; thirdly, chromium contents of up to approximately 13%, but at least approximately 8% are necessary to ensure a complete to a still satisfactory rust resistance (cf. Stainless Steels—Properties, Processing, Application—2nd Impression, Publishers Stahleisen mbH, Düsseldorf, 1989, page 19); fourthly, the content of nickel, as an austenite former counteracting the ferrite-forming elements silicon and chromium, must for a number of reasons be as low as possible. These reasons are the high costs of nickel as an alloying element and the tendency, accompanying an increase in nickel content, towards the formation of brittle nickel silicide phases. Thus, even with a plate thickness of 5 mm, the operationally produced alloy No. 6 has an homogeneous structure containing dispersed $Cr_3Ni_5Si_2$ silicide which is unusable for the application (FIG. 1). A homogeneous austenitic structure is present only after further processing to a plate 2 mm in thickness (FIG. 2). This is a consequence of the delayed equalization of the segregations originating from casting into 5 tons ingots. Such equalization is difficult in the case of high-silicon-content alloys, since the low solidus temperature does not allow any elevated heating and hot working temperatures which would produce a rapid equalization of concentration. The solidus temperature was determined, for example, as 1155° C. in the case of alloy No. 8. As in the case of alloy No. 6, a nickel content of approximately 25% accompanied by a high silicon content therefore represents a top limit value. Conversely, alloy No. 8 with approximately 22% nickel already showed the first signs of proportions of ferrite in the structure. For the nickel content of the alloy according to the invention, therefore, the lower limit value must be somewhat lower—i.e., approximately 20%. If a maximum corrosion rate of 0.3 mm per annum is tolerated in 96% sulphuric acid at 150° C., corresponding to characteristic abrasion factor 4 in DIN 50 905 Sheet 2, for the alloy disclosed in claim 2 a lower limit of silicon content of approximately 6.7% can be calculated from Equation (1) with the top chromium content limit of 13% and the top nickel content limit of approximately 25%. Due to the heavy scatter of the measured values around the equalization straight line and the resulting uncertainty of Equation (1), which is demonstrated in FIG. 3, the lower limit of the silicon content of the alloy according to the invention is set even somewhat lower, at 6.5% silicon. In accordance with Equation (1), this minimum silicon requirement is shifted to approximately 7.1% if chromium takes on the lower limit value of 8% and nickel the lower limit value of 20%. In view of the width of tolerance required for precision of analysis in heavy industrial production using the means of the steel industry and the uncertainty of Equation (1), which can be gathered from FIG. 3, to this minimum content an extra 0.4% silicon must be added, to determine therefrom the upper limit for the silicon content of the steel according to the invention as 7.5%.

The alloys No. 6 (6.6% Si) and No. 8 (7.2% Si) in Table 2 represent two embodiments of the alloy according to the invention as set forth in claim 2. It can be seen that in 96% sulphuric acid at 150° C. its maximum corrosion rate is 0.3 mm per annum. In this case, therefore, corrosion resistance can be described as good. At 200° C. with a higher corrosion rate (0.69 or 0.76 mm per annum) still an usability in the limit range is given, whereby the higher corrosion rate is taken in regard for the corresponding determination of wall thickness.

In the steel composition disclosed in claim 2, manganese contents up to 2% have a positive effect on corrosion rate. As shown in Table 2, the alloys 6 and 8, each of which contains 1.4% manganese, have in the test media stated lower linear corrosion rates than alloy 7, which was melted without the addition of manganese.

In the test conditions indicated in Table 2 the alloys 6, 7 and 8 according to the invention all show substantially lower rates of corrosion than the prior art comparison alloys 1 to 5. To reduce corrosion abrasion in 96% sulphuric acid at 200° C., the silicon content should preferably be raised to 7.5 to 8%. To counteract the disadvantage of more difficult workability with these silicon contents, starting from 20 to 25% nickel, up to 10% of the nickel content are advantageously replaced by up to 10% manganese and/or cobalt individually or together, at least 4.5% manganese or 2% cobalt required to be added. With such variations in the alloy as indicated in claims 3 to 5, in which the lower limit of the nickel content is 10%, a linear corrosion rate lower than 0.3 mm per annum can then be extrapolated for 200° C. also.

With a higher sulphuric acid concentration, application becomes increasingly more problem-free, as the linear corrosion rates for the alloys 6 and 8 in 98.5% sulphuric acid on the right-hand side of Table 2 show, so that in this case again the alloy variant set forth in claim 2 can be used.

The invention provides a silicon-containing austenitic steel which, due to its clearly-defined composition, is on the one hand sufficiently corrosion-resistant without the need to add copper, and on the other hand can be worked by hot and/or cold forming using the means of conventional steelworks technology to manufacture large products, such as are required in the form of plates and pipes for apparatus construction, without the need to add further workability-improving elements such as magnesium, aluminium, calcium and/or rare earth metals.

Figure 4:
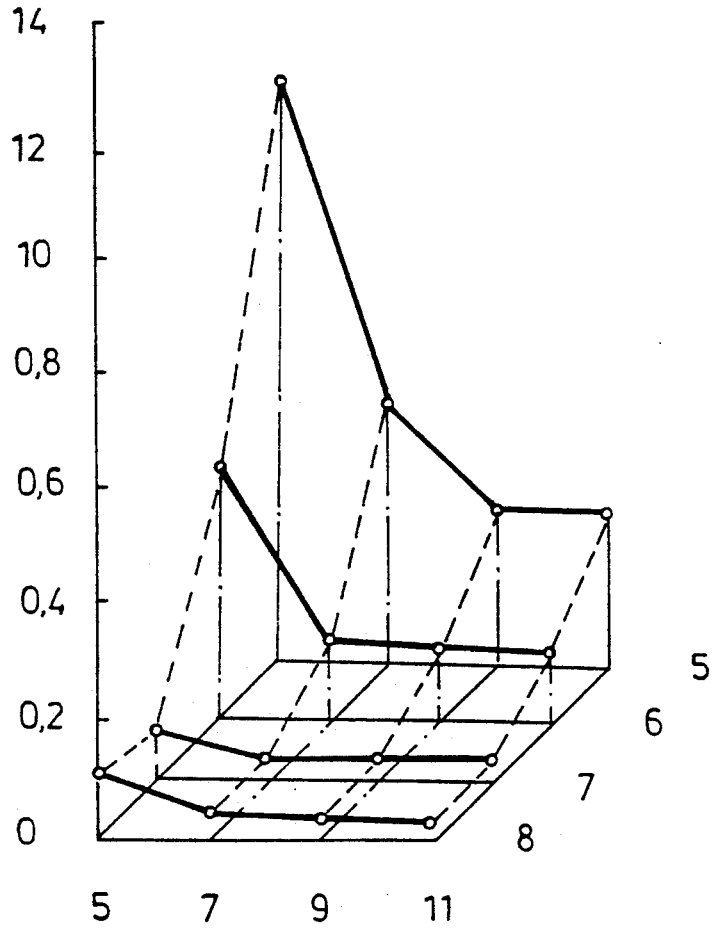

Corrosion behaviour in hot concentrated nitric acid was measured in red fuming nitric acid (minimum content 99.5% $HNO_3$) by immersion experiments in a 10 liter distillation apparatus with reflux cooler. The samples were tested in boiling acid. The boiling point was approximately 85° C. under atmospheric pressure. In the case of alloy No. 8 according to the invention in the solution annealed state of the samples (1100° C./20 min., water-quenched) a corrosion rate was obtained of less than 0.005 mm per annum, which did not increase even after a sensitization treatment lasting 10 minutes at 700° C. followed by water cooling, and of 20 minutes at 600° C. followed by air cooling. The experimental alloy No.1 , which is not according to the invention, containing 5.3% silicon and 17.9% chromium, showed in the solution annealed state a substantially higher corrosion rate of 0.02 mm per annum, which doubled in the case of the sensitized samples. The alloy according to the invention therefore also solves the problem of suitability for the handling of highly concentrated nitric acid and moreover provides advantages in comparison with prior art alloys. FIG. 4 shows clearly that with the alloy contents according to the invention of 6.5 to 8% or 6.5 to 7.5% silicon and 8 to 13% chromium a stable position of a minimum corrosion abrasion in 98% nitric acid at 100° C. is obtained.

The alloy according to the invention is also very suitable for the handling of other strongly oxidizing media such as, for example, chromic acid.

TABLE 1

Chemical composition of 8 steels (% by weight)

| | No. | Si | Cr | Ni | C | Mn |
|---|---|---|---|---|---|---|
| Prior art steels | 1 | 5.3 | 17.9 | 25.5 | 0.007 | 1.7 |
| Prior art steels | 2 | 5.6 | 19.0 | 25.7 | 0.013 | |
| Prior art steels | 3 | 5.7 | 9.0 | 18.8 | 0.024 | |
| Prior art steels | 4 | 5.9 | 9.0 | 18.4 | 0.007 | 1.7 |
| Prior art steels | 5 | 6.1 | 8.9 | 21.9 | 0.006 | 1.6 |
| According to the invention | 6 | 6.6 | 9.2 | 24.9 | 0.005 | 1.4 |
| According to the invention | 7 | 6.7 | 9.0 | 23.0 | 0.011 | |
| According to the invention | 8 | 7.2 | 8.9 | 21.9 | 0.006 | 1.4 |

residue iron and admixtures and impurities due to manufacture.

TABLE 2

Corrosion abrasion of silicon-alloyed steels in highly concentrated hot sulphuric acid, linear corrosion rates in mm per annum, mean values for measurements over 7, 14 and 21 to 23 days

| | 96% $H_2SO_4$ | | 98.5% $H_2SO_4$ | |
|---|---|---|---|---|
| No. | 150° C. | 200° C. | 150° C. | 200° C. |
| 1 | 1.30/1.34 | 1.26/1.28 | 0.51/0.55 | 0.28/0.24 |
| 2 | 1.19 | 1.09 | 0.02 | 0.24 |
| 3 | 1.58 | 1.19 | 0.48 | 0.30 |
| 4 | 1.37/1.40 | 1.68/1.69 | 0.55/0.47 | 0.39/0.40 |
| 5 | 1.42/1.46 | 1.51/1.47 | 0.22/0.19 | 0.48/0.48 |
| 6 | 0.30 | 0.69 | 0.003* | 0.022* |
| 7 | 0.75 | 1.09 | 0.05 | 0.23 |
| 8 | 0.08 | 0.76 | 0.01 | 0.06 |

*In contrast with the original experimental parameters, a sulphuric acid concentration of 98.0% was used to determine the corrosion behaviour of alloy No. 6
Alloys No. 1 to 5: prior art
Alloys No. 6 to 8: according to the invention

We claim:

1. A high-silicon-content corrosion-resistant austenitic steel comprising (in % by weight)

| | |
|---|---|
| max. 0.02% | C |
| 20 to 25% | Ni |
| 8 to 13% | Cr |
| 6.5 to 7.5% | Si |
| 0 to 2% | Mn |
| max. 0.010% | S |
| max. 0.025% | P |

balance iron including unavoidable impurities.

2. A high-silicon-content corrosion-resistant austenitic steel comprising (in % by weight)

| | |
|---|---|
| max. 0.02 | % C |
| 10 to 20 | % Ni |
| 8 to 13 | % Cr |
| 7.5 to 8 | % Si |
| 4.5 to 10 | % Mn |
| max. 0.010 | % S |
| max. 0.025 | % P |

balance iron including unavoidable impurities.

3. A high-silicon-content corrosion-resistant austenitic steel comprising (in % by weight)

| | |
|---|---|
| max. 0.02 | % C |
| 10 to 23 | % Ni |
| 8 to 13 | % Cr |
| 7.5 to 8 | % Si |
| 2 to 10 | % Mn |
| max. 0.010 | % S |
| max. 0.025 | % P |

balance iron including unavoidable impurities.

4. A high-silicon-content corrosion-resistant austenitic steel comprising (in % by weight)

| | |
|---|---|
| max. 0.02 | % C |
| 10 to 20 | % Ni |
| 8 to 13 | % Cr |
| 7.5 to 8 | % Si |
| at least 4.5 | % Mn |
| at least 2.0 | % Co |
| max. 0.010 | % S |

-continued

| | |
|---|---|
| max. 0.025 | % P |

balance iron including unavoidable impurities, the total of the manganese and cobalt contents being limited to 10%.

5. A steel according to one of claims 1–4 for the production of corrosion-resistant articles for the handling of highly concentrated hot sulphuric acid, highly concentrated hot nitric acid and other strongly oxidizing media, such as chromic acid.

6. A steel for the purpose according to claim 5 in semifinished form of rolled plates, strips, pipes, rods, wires and other forms of product.

* * * * *